US008225839B2

(12) United States Patent
Prine, Sr.

(10) Patent No.: US 8,225,839 B2
(45) Date of Patent: Jul. 24, 2012

(54) RETRACTABLE AWNING WITH AUTOMATIC PITCHING GABLE OR ARCH

(76) Inventor: Kenneth C. Prine, Sr., St. Augustine, FL (US)

( * ) Notice: Subject to any disclaimer, the term of this patent is extended or adjusted under 35 U.S.C. 154(b) by 0 days.

(21) Appl. No.: 12/633,380

(22) Filed: Dec. 8, 2009

(65) Prior Publication Data

US 2011/0132552 A1 Jun. 9, 2011

(51) Int. Cl.

| | |
|---|---|
| ***E06B 9/00*** | (2006.01) |
| ***E04F 10/00*** | (2006.01) |
| ***E04F 10/02*** | (2006.01) |
| ***E04F 10/06*** | (2006.01) |

(52) U.S. Cl. ..... 160/22; 160/56; 160/70

(58) Field of Classification Search ..... 160/22, 160/369, 405, 50, 51, 52, 66, 76, 77, 79, 160/56, 59, 60, 64, 45, 57, 58.1, 262, 352
See application file for complete search history.

(56) References Cited

U.S. PATENT DOCUMENTS

| | | | | |
|---|---|---|---|---|
| 1,948,788 | A * | 2/1934 | Goldberg et al. | 403/120 |
| 6,782,936 | B1 * | 8/2004 | Girard et al. | 160/66 |
| 6,820,673 | B2 * | 11/2004 | Wessels | 160/70 |

* cited by examiner

*Primary Examiner* — Katherine w Mitchell
*Assistant Examiner* — Jeremy Ramsey
(74) *Attorney, Agent, or Firm* — Jamin D. Rubenstein

(57) ABSTRACT

A retractable awning that transforms automatically into a gable or arch is disclosed. The awning sheet extends using articulated hinged arms. A first end of each articulated arm is hingedly affixed to a stationary surface. The two articulated arms provide vertical support while extending the awning sheet. A swiveling hinge interface connects the ends of the articulated arms and the front support member. The front support member is a flexible spring member and resiliently arches the awning when extending. In another embodiment, the front support member is a left member and right member connected by a hinge and a spring. The spring resiliently urges the left and right member into a gabled configuration, thereby gabling the awning. When retracting the awning, the ends of the front support member and awning sheet are pulled outwards, thereby counteracting the naturally gabled or arched configuration.

1 Claim, 5 Drawing Sheets

RETRACTABLE AWNING WITH AUTOMATIC PITCHING GABLE OR ARCH

BACKGROUND OF THE INVENTION

1. Field of the Invention

The invention relates generally to the field of retractable awnings and specifically to a system for automated pitching of the awning to transform into a gable or arch.

2. Background

Retractable awnings are mostly flat and mainly used for sun protection on office buildings, multi-unit dwellings, single family homes, recreational vehicles, etc. To prevent damage from rain, the awnings are retracted. If not, a water basin can form on the awning sheet. To alleviate this problem, flat awnings are pitched downwards from a wall or other fixed surface and users may be forced to push up the middle of the awning sheet to release the water and/or debris.

Pitching the awning downwards may be permanent and can require a mounting height of greater than 15 feet, making it too high to reach without a ladder or extension device to assist in pushing up any saggy basin. Other installations requiring a shorter installation height but similar pitch, make headroom limited for use. Pitching awnings downwards are also impractical because they direct all precipitation and residue down and forward in front of the front bar of the awning possibly over a walk way, thereby impeding egress and ingress.

Pitching is either manual or electric and both ways present problems. Electric problems can prevent any pitching and manual pitch adjustment gear may be impractical because it can require two people to adjust the pitch. For example, the awning first must be fully extended, then multiple steps are required to achieve the desired pitch. One person has to hold up the front portion of the awning to reduce the load on the pitching gears, and the another person has to insert a hook end of an elongated bar into a hand crank, and manually turn the hand crank in a clockwise or counterclockwise direction to attain the desired pitch. This is impractical for the elderly, or people with limited dexterity or strength.

An attempt to solve the problem has been made by manually gabling a flat retractable awning into a gabled awning using a joint mechanism requiring a user to hold a rod or other elongated device and manually urge the front portion of the awning upwards after the awning is fully extended. This is impractical for the following reasons: using a rod or other elongated device to manually urge the front portion of the awning upwards is difficult for some people who cannot lift their arms over their head, the resistance of the front portion of the awning may be difficult for individuals with limited strength or manual dexterity, and if the awning is installed high, a ladder or a very long, heavy rod would be required to reach the joint mechanism, making transformation dangerous. Additional storage space is also required for the rod or elongated device.

What is needed is a retractable awning that will gable or arch automatically when extending without any user action.

SUMMARY

In accordance with the invention, the problems of transforming a flat awning into a gabled configuration manually are avoided by having the front edge urge upwards without user action while the awning is being extended from a building or recreation vehicle.

In one embodiment, a retractable awning apparatus is disclosed where the front support member is a flexible spring member biased upwards in a naturally arched configuration.

This flexible spring member resiliently urges the front edge of the awning upwards into an arched configuration when extending the awning sheet from the roller. As the awning sheet is pulled around the roller when retracting, the articulated arms are pulled towards the frame and the opposable ends of the flexible spring member and awning sheet are pulled outwards, thereby counteracting the naturally arched configuration of the flexible spring member.

In a second embodiment, a retractable awning apparatus is disclosed with a front support member having a left front member and right front member connected by a hinge and a spring. This spring resiliently urges the left member and right member into a gabled configuration when extending the awning sheet from the roller. As the awning sheet is pulled around the roller when retracting, the articulated arms are pulled towards the frame and the left front member and right front member are pulled outwards at opposable ends, thereby counteracting the naturally gabled configuration of the spring, and aligning the left front member and the right front member horizontally.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
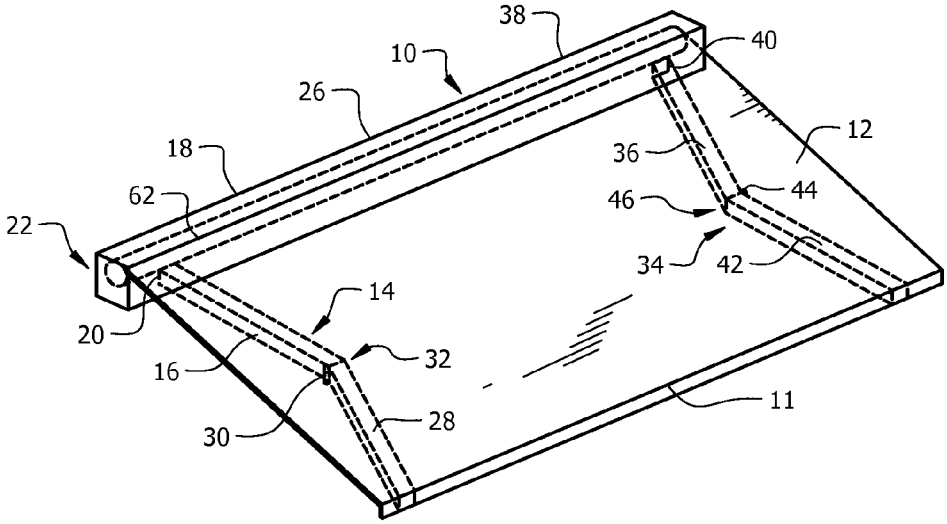
FIG. 1 (Prior Art)
FIG. 1 is a perspective view of a system of the prior art.

Reference will now be made in detail to the presently preferred embodiments of the invention, examples of which are illustrated in the accompanying drawings. Throughout the following detailed description, the same reference numerals refer to the same elements in all figures. In the preferred embodiments, references made to a gable or arch can be used interchangeably.

FIG. 1 is a perspective view of a prior art retractable awning 10. FIG. 1 shows a flat front bar 11 common to prior art retractable awnings 10 When the prior art retractable awning 10 is extended, the awning fabric often sags in the middle due to the weight of water, etc. creating a basin. These awnings often must be rolled in to prevent them from collapsing or a user has to push up the middle of the flexible awning sheet 12 to release the water on the sides or front. Shown in FIG. 1 is a left articulated arm 14, with a left proximal member 16 and left distal member 28 connected together by a second left hinge 30 forming a left joint 32. The left proximal member 16 is connected to the frame 22 on the left portion 18 of the frame forming a first left hinge 20. The right articulated arm 34, with a right proximal member 36 and right distal member 42 are connected together by a second right hinge 44 forming a right joint 46. The right proximal member 36 is connected to the frame 22 on the right portion 38 of the frame forming the first right hinge 40. The articulating arms 34, 14 are connected to the flat front bar 11 for support and extension. A flexible sheet 12 is attached to a roller 62 inside a housing 26. The frame 22 is attached behind the housing 26 to the surface of a wall (shown in FIG. 2B).

Figure 2A:
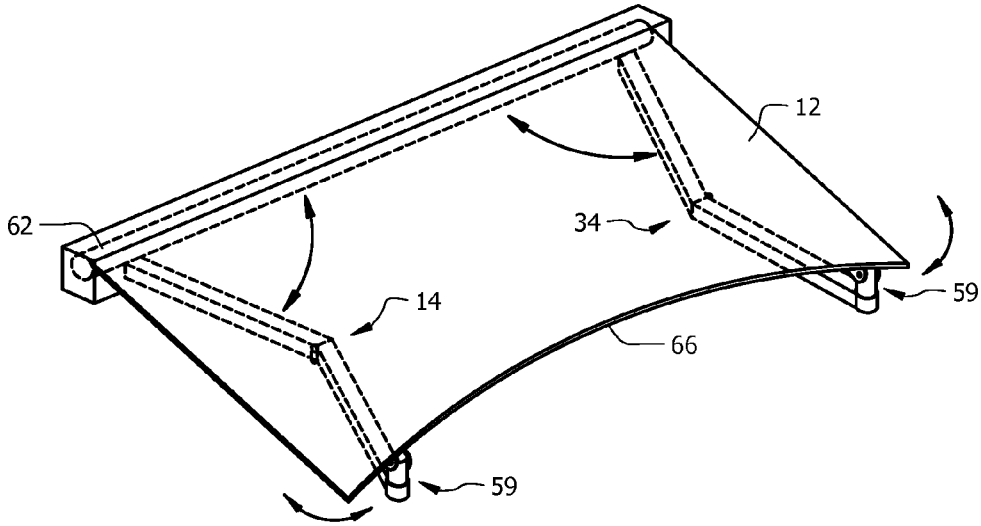
FIG. 2A is a perspective view of a system of a first embodiment of the present invention.

FIG. 2A shows the first embodiment of the present invention with a flexible spring member 66. The flexible spring member 66 is sewn into the flexible sheet 12 and both are connected to the articulated arms 14, 34 by a swiveling hinge interface 59. For example, each hinge is connected to the flexible spring member 66 and swivels on each articulated arm 14, 34. (shown in FIG. 2B, 2C). This allows the articulated arms 14, 34 to extend outwards and the flexible spring member 66 to resiliently urge the flexible sheet 12 upwards into an arched configuration, thereby providing runoff on the sides, as opposed to the front of the awning as in the prior art. As the awning sheet is pulled around the roller 62 when retracting, the articulated arms 14, 34 pull opposable ends of the flexible spring member 66 and flexible sheet 12 outwards at the swiveling hinge interfaces 59, thereby counteracting the natural arched configuration of the flexible spring member 66.

Figure 2B:
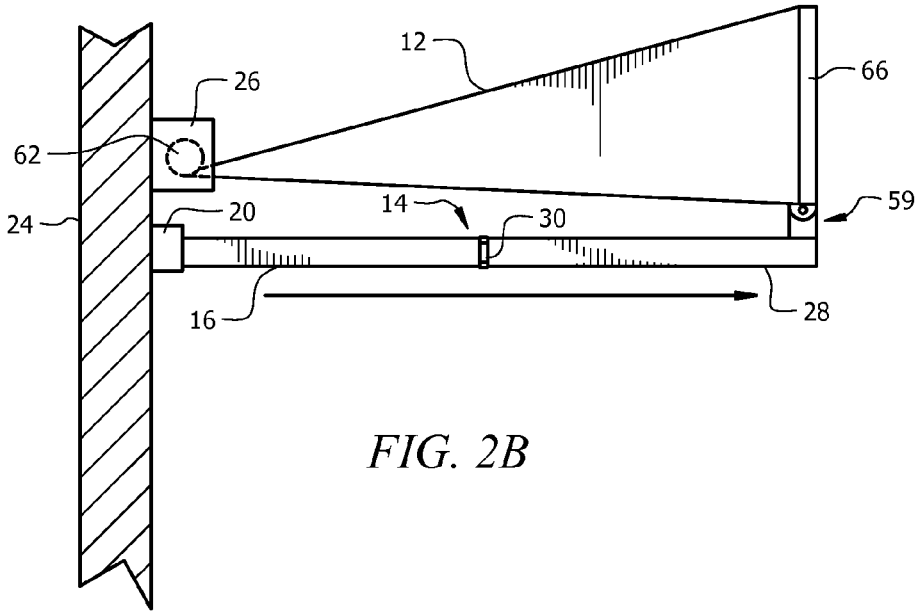
FIG. 2B is a side view of a system of a first embodiment of the present invention.

FIG. 2B is left side view of the first embodiment of the present invention showing the flexible sheet 12. The housing 26 is connected to the surface of a building 24 and houses a roller 62. The left articulated arm 14 is connected to the surface of the building 24 by the first left hinge 20. The left proximal member 16 and left distal member 28 are connected by the second left hinge 30. The flexible spring member 66 is sewn into the flexible sheet 12 and both are shown connected to the left articulated arm 14 by a swiveling hinge interface 59.

Figure 2C:
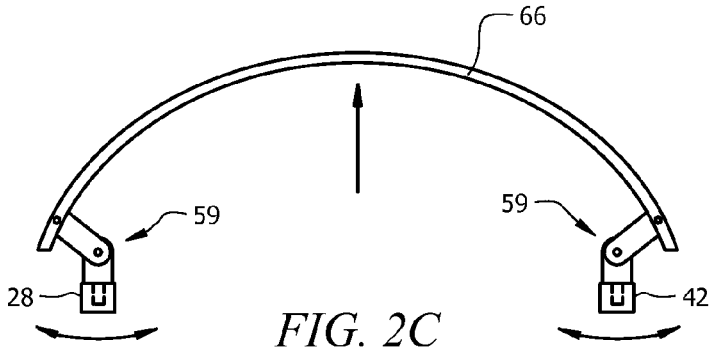
FIG. 2C is a front view of a system of a first embodiment of the present invention.

FIG. 2C is the front view of the first embodiment of the present invention showing the flexible spring member 66 urged upwards in a natural arched configuration and connected to the left distal member 28 and right distal member 42 by the swiveling hinge interfaces 59.

Figure 3A:
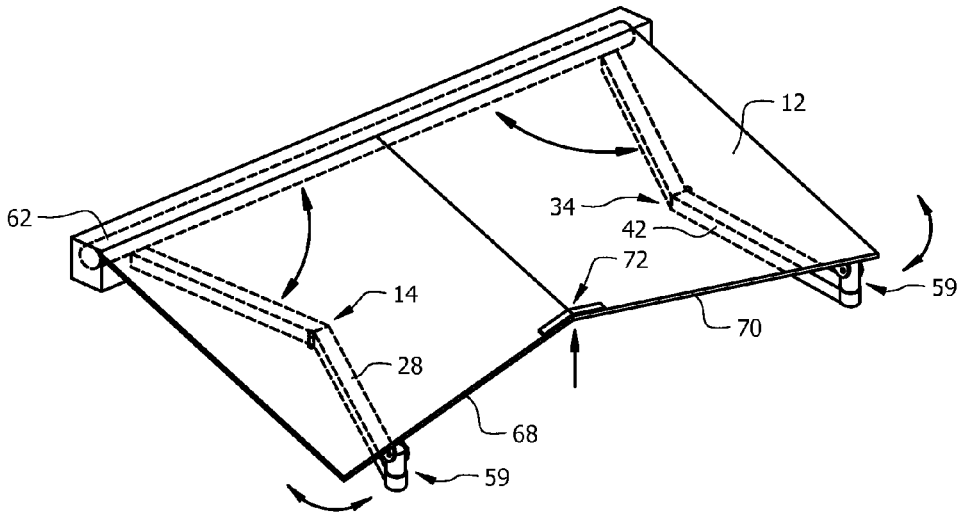
FIG. 3A is a perspective view of a system of a second embodiment of the present invention.
Figure 3B:
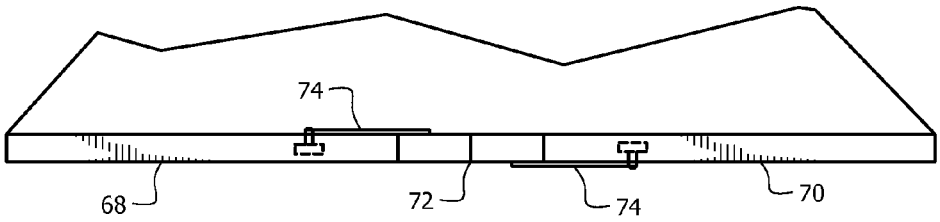
FIG. 3B is a top view of a system of a second embodiment of the present invention.
Figure 3C:
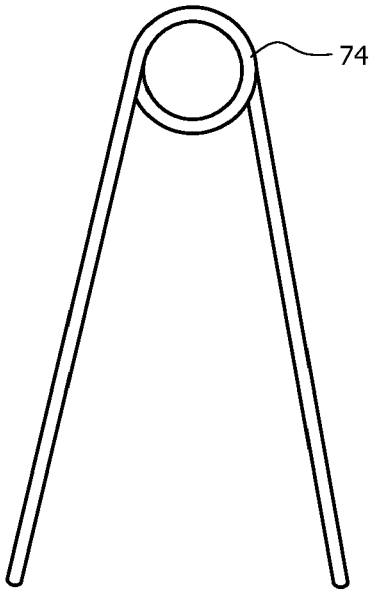
FIG. 3C is a front view of a spring in a natural configuration.
Figure 3D:
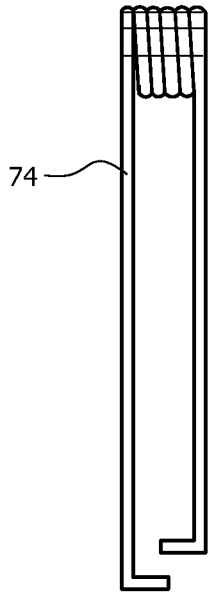
FIG. 3D is a side view of a spring in a natural configuration.
Figure 3E:
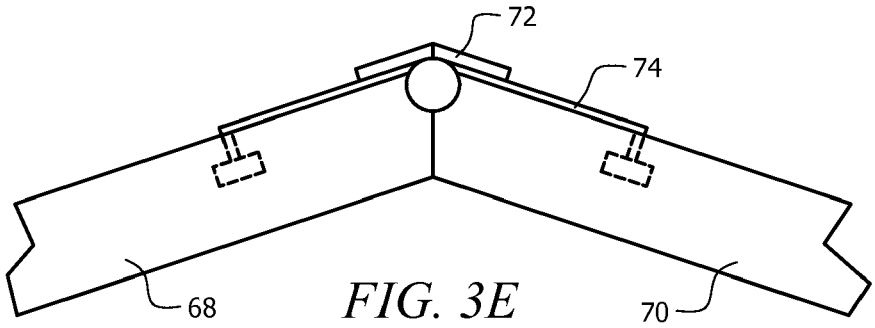
FIG. 3E is an exploded front view of the spring loaded joint connecting two support members in a natural configuration.

FIG. 3A shows the second embodiment of the present invention with a left member 68 and right member 70 connected by a hinge 72 and a spring (shown in FIG. 3E). The left member 68 and right member 70 are each connected to the articulated arms 14, 34 by a swiveling hinge interface 59. For example, one hinge is connected to the left member 68 and one hinge is connected to the right member 70 and each hinge swivels on the end of each distal member 28, 42 of the articulated arms 14, 34. When extending the awning sheet 12 from the roller 62, a spring (shown in FIG. 3E) resiliently urges the front portion of the awning upwards into a naturally gabled configuration, thereby providing runoff on the sides, as opposed to the front of the awning in the prior art. As the awning sheet 12 is pulled around the roller when retracting, the left distal member 28 and right distal member 42 articulate towards the wall and pull outwards both outside ends of left front member 68 and right front member 70 at the swiveling hinge interfaces 59, thereby counteracting the spring (shown in FIG. 3F), and aligning the left front member 68 and right front member 70 horizontally.

Figure 3F:
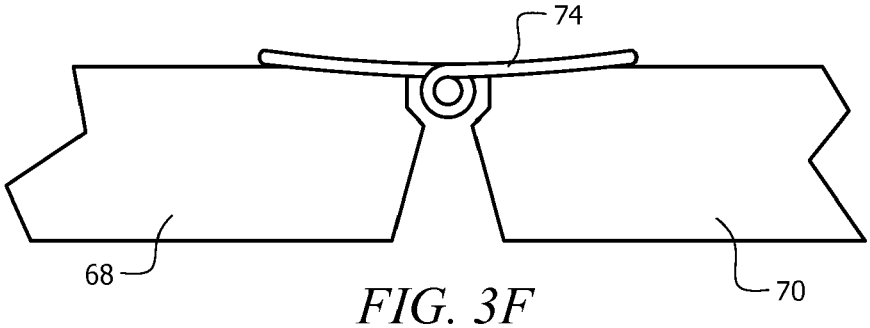
FIG. 3F is an exploded front view of the spring and hinge connecting two support members in a flattened configuration.

FIG. 3B shows the top view of the second embodiment of the present invention with a spring 74 and the hinge 72 attached to the left member 68 and right member 70 in a flattened configuration. FIG. 3C shows the front view of the spring 74 in a natural configuration. FIG. 3D shows the side view of the spring 74 in a natural configuration. FIG. 3E shows an exploded front view of the hinge 72 and a spring 74 connecting the left front member 68 and right front member 70 in a gabled configuration. FIG. 3F shows an exploded front view of the spring 74 attached to the left member 68 and right member 70 in a flattened configuration.

Figure 4:
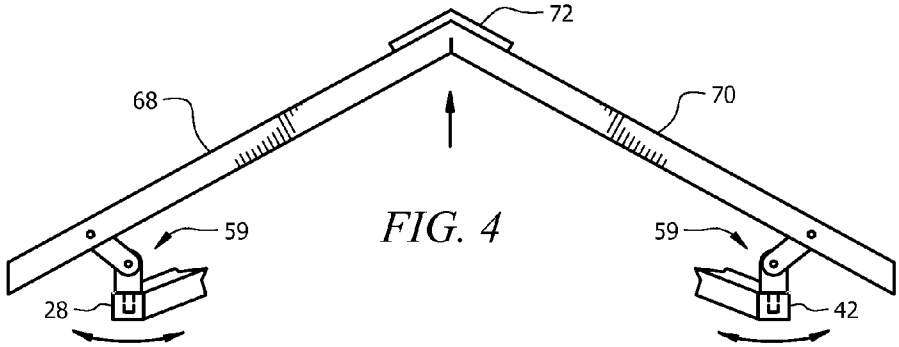
FIG. 4 is a front view of a system of a second embodiment of the present invention.

FIG. 4 shows a front view of the second embodiment of the present invention with a left member 68 and right member 70 connected together by a hinge 72 in a gabled configuration. The left front member 68 and right front member 70 are connected to the left distal member 28 and the right distal member 42 by the swiveling hinge interfaces 59. For example, one hinge is connected to the left member 68 and one hinge is connected to the right member 70 and each hinge swivels on the ends of each distal member 28, 42 allowing the front edge portion of the flexible sheet to gable as it extends.

Figure 5:
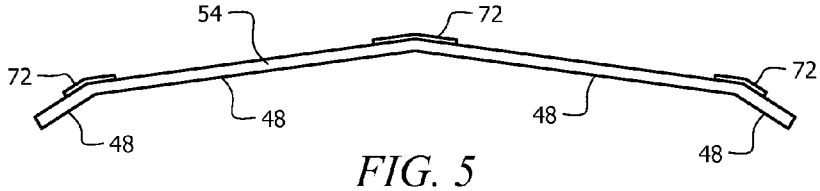
FIG. 5 is a front view of a gabled configuration in a third embodiment of the present invention.
Figure 6:
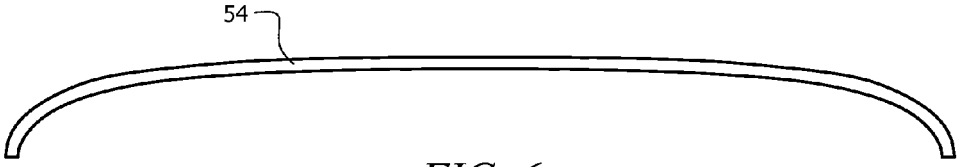
FIG. 6 is a front view of an arched configuration in a fourth embodiment of the present invention.

FIG. 5 shows a front view of an awning in a third embodiment of the present invention with the front edge portion of the flexible sheet 54 with hinges 72 connecting front support members 48 in a multi-gabled configuration. FIG. 6 shows a front view of an awning in a fourth embodiment of the present invention with the front edge portion of the flexible sheet 54 having an arched configuration with a flexible spring member 66 (shown in FIG. 2A). It is anticipated that an awning may be manufactured with any number of gables.

A retractable awning with an automatic pitching gable/arch configuration has been shown which serves the purposes sought herein. Modifications, variations, other uses, and applications of the present invention will become apparent to those skilled in the art after considering the specifications and the drawings which disclose the present invention. Modifications, variations, other uses, and applications not outside the scope and spirit of the present invention are deemed covered by the present invention.

Equivalent elements can be substituted for the ones set forth above such that they perform in substantially the same manner in substantially the same way to achieve substantially the same result. It is believed that the apparatus and system of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and an explanatory embodiment thereof. It is the intention of the following claims to encompass and include such changes.

What is claimed is:

1. A retractable awning having an automated pitching gable or arch, the awning comprising:

(a) a flexible sheet;

(b) a left articulated arm, including a left proximal member connected to a left portion of a frame by a first left hinge, the frame is attached to a surface of a building and is located behind a housing, a left distal member, the left proximal member connected to the left distal member by a second left hinge to form a left joint;

(c) a right articulated arm, including a right proximal member connected to a right portion of the frame by a first right hinge, the frame is attached to a surface of the building and is located behind the housing, a right distal member, the right proximal member connected to the right distal member by a second right hinge to form a right joint;

(d) a front support member, having a first end rotatably affixed to an end of the left articulated arm and a second end rotatably affixed to an end of the right articulated arm, a front edge portion of the flexible sheet is affixed to the front support member by a connector selected from the group consisting of a swiveling hinge interface and stitching, wherein the front support member is a flexible spring member biased upward in an arched configuration;

(e) the housing, having a roller, the proximal portion of the flexible sheet is connected to the roller, a motor coupled to the roller, the motor extends the flexible sheet when the motor rotates in a first direction and the motor retracts the flexible sheet when the motor rotates in a second direction.

* * * * *